United States Patent [19]

Koshida et al.

[11] Patent Number: 5,057,652

[45] Date of Patent: Oct. 15, 1991

[54] DISTRIBUTOR FOR AN INTERNAL COMBUSTION ENGINE

[75] Inventors: Ryoichi Koshida; Hiromitsu Nagae, both of Katsuta; Takanori Satou, Hitachi, all of Japan

[73] Assignee: Hitachi, Ltd., Tokyo, Japan

[21] Appl. No.: 578,203

[22] Filed: Sep. 6, 1990

[30] Foreign Application Priority Data

Sep. 14, 1989 [JP] Japan ..... 1-237244

[51] Int. Cl.[5] ..... H01H 19/00; F02P 7/00

[52] U.S. Cl. ..... 200/19 DC

[58] Field of Search ..... 200/19 R, 19 DC, 5 A, 200/144 C, 302.1

[56] References Cited

U.S. PATENT DOCUMENTS

| | | | |
|---|---|---|---|
| 3,745,271 | 7/1973 | Brasty | 200/19 DC |
| 4,351,309 | 9/1982 | Schleupen et al. | 200/19 DC X |
| 4,409,444 | 10/1983 | Yoshiyasu et al. | 200/144 C X |
| 4,642,433 | 2/1987 | Murata | 200/5 A X |

FOREIGN PATENT DOCUMENTS 3305187 9/1983 Fed. Rep. of Germany .

*Primary Examiner*—J. R. Scott

*Attorney, Agent, or Firm*—Antonelli, Terry, Stout & Kraus

[57] ABSTRACT

A distributor for an internal combustion engine includes a housing in which a distributor rotor is supported on a shaft for distributing a generated high voltage to ignition plugs through electrodes, and a distributor cap covers electrical devices of the distributor. The distributor cap of an insulating material is composed of an inner distributor cap and outer distributor cap of a high strength material space is formed between the walls of outer distributor cap and inner distributor cap for preventing dewing. A number of T-shaped projections may be provided along an inner surface of the outer distributor cap for defining the space, with the projections being fixed to the inner distributor cap or a spacer may be sandwiched between the inner and outer distributor caps.

5 Claims, 2 Drawing Sheets

DISTRIBUTOR FOR AN INTERNAL COMBUSTION ENGINE

BACKGROUND OF THE INVENTION

This invention relates to a distributor and more, and particularly to a distributor for an internal combustion engine to prevent dew from generating on the inner wall of the distributor cap when the cap is quickly chilled by water drops entering into an engine compartment.

Many types of distributors are known as , for example, in the Japanese laid open Patent Publication Sho 58-44273(1983). The prior art, however, is not interested in solving the problem of dewing on the inner wall of the distributor cap when the cap is chilled by water drops. If the dewed water drops go down inside of the distributor, high voltage devices, such as a distributor rotor, distributor electrodes, are wetted, and all functions of the distributor deteriorate.

It is possible to solve the problem by covering the distributor with a cover for preventing dewing. However, there is considerable trouble in fixing the cover to the housing and danger of unfastening of the cover by vibration of the vehicle.

SUMMARY OF THE INVENTION

An object of the present invention is to provide a distributor for preventing dewing when the distributor is quickly chilled by entering water drops.

Another object of the present invention is provide a distributor for an internal combustion engine for preventing waste water from entering inside of the distributor even if the distributor is disposed at the position which the waste water may easily be splashed on the distributor.

Further object of the present invention is to provide a high reliable distributor with a good mechanical strength and good electrical insulating ability.

In accordance with the present invention a distributor is formed a double layer cap structured by an outer distributor cap and distributor cap, and by providing a space for preventing dewing between the outer distributor cap and inner distributor cap and integrally fixing the outer and inner distributor caps to the housing.

In accordance with further features of the present invention, the outer distributor cap is formed of a material having a high mechanical strength and the inner distributor cap is formed of a material having a good electrical insulating ability.

DESCRIPTION OF THE PREFERRED EMBODIMENTS

Figure 1:
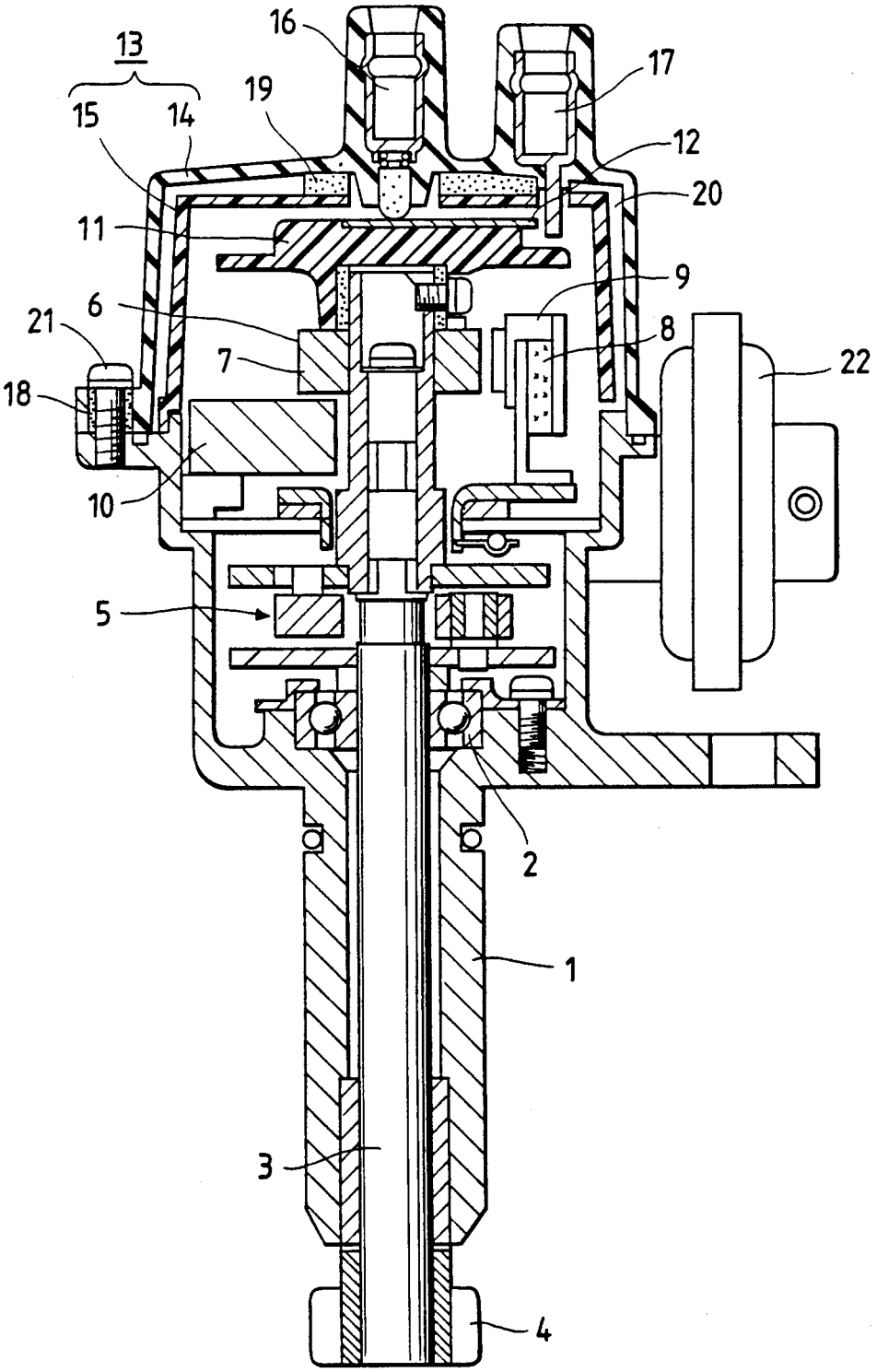
FIG. 1 is an elevational sectional view of a distributor showing an embodiment of the present invention.

An internal combustion engine distributor, as shown in FIG. 1, comprises a housing 1, shaft 3 rotatably mounted on the housing 1 by a bearing 2, a gear 4 supported at one end of the shaft 3, an ignition timing advancing device 5, an on-off device 6 which chops a primary current of ignition coil (not shown), a distributor rotor 11 supported to the other end of the shaft 3, a rotor electrode 12 fixed to the distributor rotor 11, a distributor cap 13, and a capacitor 22 mounted on the outside wall of the housing 1.

The gear 4 fixed to the shaft 3 engages a gear (not shown) fixed to a cam shaft of the internal combustion engine (not shown). The shaft 3 is rotated, synchronously with a crank shaft (not shown) of the internal combustion engine (four-cycle engine) at a speed half as high as that of this crank shaft.

The on-off device 6 includes a signal rotor 7 mounted on the shaft 3, a field magnet 8 supported on the housing 1 in opposition to the signal rotor 7, an electro-magnetic pick-up coil 9 secured to the field magnet 8, and a ignition amplifier 10 mounted on the housing 1.

A voltage induced in the electro-magnet pick-up coil 9 in accordance with the rotation of the signal rotor 7 is used to control the interruption of the current flow in the primary winding (not shown) of the ignition coil through an ignition amplifier 10.

The double distributor cap 13 is composed of an outer cap 14 and inner cap 15. The outer cap 14 is made of a material with high mechanical strength, such as for example, polybutylene terephthalate resin (PBT). The outer cap 14 has a electrode 16 supplied with a high voltage current from the ignition coil (not shown), a electrode 17 for supplying a distributed voltage from the distributor rotor 11 and the rotor electrode 12 to an ignition plugs (not shown), and a bush 18 integrally fixed to a connecting portion.

The inner distributor cap 15 is made of a good electrical insulating material, such as, for example, polypropylene resin. The inner cap 15 is formed so as to be able to cover all devices mounted on the upper part of the housing 1, and to form a space 20 for preventing dewing between the inner distributor cap and the outer distributor cap.

A packing 19 is inserted between the outer cap 14 and inner cap 15. A connecting screw 21 is inserted into the bush 18 provided on the outer distributor cap 14 and to a nut fixed to the housing 1, thereby fixing the outer distributor cap 14 to the housing 1. The inner cap 15 is pushed to the housing 1 through the packing 19 thereby fastening the inner cap 15 to the housing 1. A space 20 for preventing dewing is formed between the outer distributor cap 14 and inner distributor cap 15.

In the above described embodiment, as the space 20 for preventing dewing is formed between the outer and inner distributor caps 14 and 15, even if the distributor is splashed with water during operation, the wall of the inner distributor cap 15 is not rapidly cooled, therefore, deterioration in functioning of the distributor due to the dewed water and dropping of the dewed water drops is avoided.

Even if the distributor is placed at the position in the engine compartment at which which the waste water easily splashes the distributor, the waste water is prevented from entering into the inner space 20 because of the double layered cap of the distributor, and there is no need to cover the distributor with the big cover.

Since the outer distributor cap 14 is made of a material having high mechanical strength, such as polybutylene terephthalate resin (PBT) and the inner distributor cap 15 is made of a material having a good electrical insulating material, such as polypropylene resin, the mechanical strength as well as the electrical insulating ability is very high.

Figure 2:
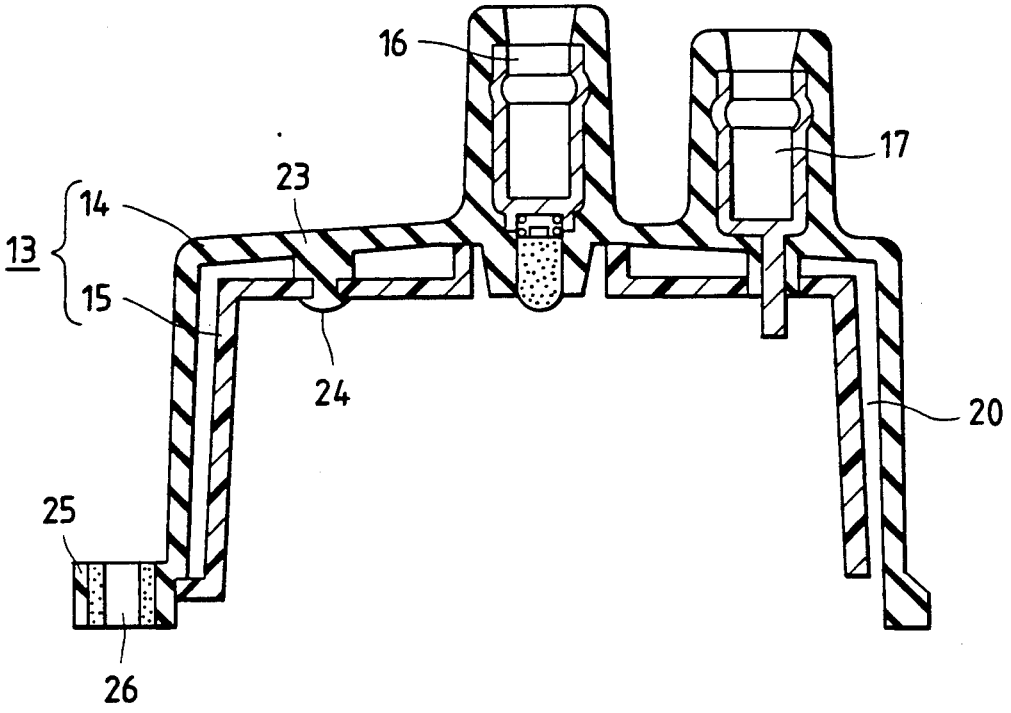
FIG. 2 is a partial sectional view of a distributor showing another embodiment of the present invention.

In the embodiment of FIG. 2, a plurality of T-shaped projections 23 are provided at the ceiling of the outer distributor cap 14, with the inner cap 15 welded and fixed to the outer distributor cap 14 through the projections 23. The welded portion is shown at 24.

A common connecting portion 25 is formed at the end portion of the outer distributor cap 14 and inner distributor cap 15, a bush 26 is secured integrally to the connecting portion 25. A connecting bolt (not shown) is inserted into the bush 26 for integrally fixing the outer distributor cap 14 and inner distributor cap 15 to the housing 1.

As a result, the embodiment of FIG. 2 is able to keep the outer distributor cap 14 and inner distributor cap 15 with accurate relative position and to easily fix them to the housing 1.

In the present invention, the outer distributor cap 14 and inner distributor cap 15 may be bonded after sandwiching a spacer therebetween and forming a space 20 for preventing dewing. Further, the outer distributor cap 14 and inner distributor cap 15 may be bonded by casting a metal pin into the outer distributor cap 14 and caulking the pin at the inner side of the inner distributor cap 15.

We claim:

1. A distributor or an internal combusion engine comprising:

a housing;

a shaft rotatably mounted in said housing to rotate synchronously with the rotation of the internal combustion engine;

a distributor rotor supported on said shaft and including a rotor electrode means for distributing generated high voltage;

an outer distributor cap having first electrode means mounted therein and supplied with high voltage current and further electrode means mounted therein for supplying a distributed voltage from the rotor electrode means of the distributor rotor;

an inner distributor cap of an electrically insulating material nested inside of said outer cap so as to form a space between said outer distributor cap and said inner distributor cap when said inner distributor cap and said outer distributor cap are mounted on said housing, said space being defined between opposed surfaces of said outer distributor cap and outer surfaces of said inner distributor cap respectively defining an inner and outer surface of the outer distributor cap and the inner distributor cap, and means for fixedly securing said outer distributor cap and said inner distributor cap to said housing.

2. A distributor for an internal combustion engine according to claim 1, wherein said outer distributor cap is made of a polybutylene terephthalate resin, and wherein the material of said inner distributor cap is a polypropylene resin.

3. A distributor for an internal combustion engine according to claim 1, further comprising a spacer means sandwiched between said outer distributor cap and said inner distributor cap for maintaining the space therebetween.

4. A distributor for an internal combustion engine according to claim 1, further comprising T-shaped projection means provided along an inner surface of said outer distributor cap for securing said inner distributor cap to said outer distributor cap.

5. A distributor for an internal combustion engine according to claim 1, further comprising a packing means interposed between at least a portion of the inner surface of said outer distributor cap and a portion of an opposed outer surface of said inner distributor cap for urging said inner distributor cap against the housing when said outer distributor cap is secured thereto by said means for fixedly securing.

* * * * *